US008659416B1

(12) United States Patent
Higgins

(10) Patent No.: US 8,659,416 B1
(45) Date of Patent: Feb. 25, 2014

(54) INSTRUMENT FOR DETECTING AND ALERTING DURING AN EMERGENCY SITUATION

(76) Inventor: Victor M. Higgins, Ovid, MI (US)

( * ) Notice: Subject to any disclaimer, the term of this patent is extended or adjusted under 35 U.S.C. 154(b) by 280 days.

(21) Appl. No.: 13/007,085

(22) Filed: Jan. 14, 2011

Related U.S. Application Data

(60) Provisional application No. 61/294,922, filed on Jan. 14, 2010.

(51) Int. Cl.
*G08B 29/00* (2006.01)

(52) U.S. Cl.
USPC ..... 340/514; 340/691.1; 340/815.4

(58) Field of Classification Search
USPC ..... 340/514, 691.1, 815.4; 362/551, 565
See application file for complete search history.

(56) References Cited

U.S. PATENT DOCUMENTS

| | | | | |
|---|---|---|---|---|
| 3,543,017 | A * | 11/1970 | Mihailoff | 362/86 |
| 3,810,170 | A | 5/1974 | Zinsmeister | |
| 4,365,238 | A | 12/1982 | Kollin | |
| 4,380,759 | A | 4/1983 | Sulkoski et al. | |
| 4,694,285 | A * | 9/1987 | Scripps | 340/693.2 |
| 5,045,833 | A | 9/1991 | Smith | |
| 5,589,824 | A | 12/1996 | Lynch | |
| 5,731,759 | A | 3/1998 | Finucan | |
| 5,801,633 | A | 9/1998 | Soni | |
| 6,611,204 | B2 | 8/2003 | Schurr | |
| 8,089,370 | B2 * | 1/2012 | Richmond | 340/815.4 |
| 2005/0279403 | A1 * | 12/2005 | Kube | 136/291 |
| 2006/0265195 | A1 * | 11/2006 | Woodard et al. | 702/188 |

* cited by examiner

*Primary Examiner* — Brian Zimmerman
*Assistant Examiner* — An T Nguyen
(74) *Attorney, Agent, or Firm* — Robert C. Montgomery; Montgomery Patent & Design

(57) ABSTRACT

An alarm system with an integral high-intensity illumination means comprising reflective beads for increased visibility is intended to provide alarm notification for the hard-of-hearing or deaf individuals. The illumination means on the bottom provides visual notification to deaf or hard of hearing building occupants and those who may outside of the building. To aid in the visual observation of the illumination means, a series of reflective beads are hung from the bottom of the detector.

10 Claims, 6 Drawing Sheets

INSTRUMENT FOR DETECTING AND ALERTING DURING AN EMERGENCY SITUATION

RELATED APPLICATIONS

The present invention was first described in and claims the benefit of U.S. Provisional Application No. 61/294,922 filed Jan. 14, 2010, the entire disclosures of which are incorporated herein by reference.

FIELD OF THE INVENTION

The present invention relates generally to emergency alarm systems, and in particular, to emergency alarm systems such as smoke detectors which provide visual alerts.

BACKGROUND OF THE INVENTION

Some of the most important fixtures in any home or building are safety alarm devices such as smoke detectors and fire alarms, carbon monoxide detectors, security sensors, and the like. Conventionally, these alarms provide loud audible alerts when activated so that all persons in the general vicinity are made well aware of the corresponding safety concern.

In large building establishments and public place, such alarms may include a flashing light which further indicates that the alarm has been tripped. However, many residential models do not include such a feature. This is particularly worrisome for hearing impaired individuals for whom an audible alarm is ineffective. Such persons generally rely upon visual stimuli to alert them as to environmental conditions.

Various attempts have been made to provide alarm devices with alert methods adapted for hearing impaired individuals. Examples of these attempts can be seen by reference to several U.S. patents. U.S. Pat. No. 3,810,170, issued in the name of Zinsmeister, describes an alarm system including a signaling panel with a plurality of high intensity lights. The colors of the particular lights indicate a variety of alarm-triggering conditions such that the user is informed of the nature of the alarm.

U.S. Pat. No. 4,365,238, issued in the name of Kollin, describes a visual signaling apparatus in electrical communication with a plurality of sensing devices individually located adjacent to a sound producing device such as a telephone or doorbell. Upon activation of a sensing device, the user is notified by a visual signal.

U.S. Pat. No. 4,380,759, issued in the name of Sulkoski et al., describes system including an alarm device such as a smoke detector and a receiver with a vibrating reed which provides a tactile alert to a user when the alarm is activated.

While these devices fulfill their respective, particular objectives, each of these references suffer from one (1) or more of the aforementioned disadvantages. Many such devices do not provide a visual alert or a level capable of waking a person or which is readily visible from adjacent rooms. Also, many such devices are difficult to install, mount, wire, or configure. Furthermore, many such devices are unsightly even though they must be installed in readily visible locations. Accordingly, there exists a need for a visual alarm device without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for an alarm providing a strong and readily identifiable visual alert for a plurality of emergency situations which is aesthetic and readily installed. Thus, the object of the present invention is to solve the aforementioned disadvantages and provide for this need.

To achieve the above objectives, it is an object of the present invention to detect an emergency situation and relay a visual alert primarily utilized for persons who are hearing impaired. The apparatus includes an upper plate, a lower plate, a plurality of decorative beads located between the plates, and an illumination device. The apparatus also includes an internal sensor and a mounting bracket.

Yet still another object of the present invention is to provide a noticeable visual alert by causing the illumination means to flash erratically when the sensor is triggered. The illumination means preferably includes a light-emitting diode.

Yet still another object of the present invention is to provide a favorable aesthetic appearance due to the plurality of beads. The beads are attached along a plurality of bead attachments comprising rods, strings, or similar structures. Each bead attachment is attached at a top end to a lower surface of the upper plate and is attached to the lower plate at a bottom end.

Yet still another object of the present invention is to provide the beads with reflective characteristics which increase the range and luminosity of the illumination device in order to further ensure that a user is visually alerted when the alarm is triggered. The beads are constructed of a transparent plastic or glass material and can comprise prismatic properties which disperse the light in order to provide additional visibility and aesthetic qualities.

Yet still another object of the present invention is to include an operating light which indicates to a user that the apparatus is functioning properly. The operating light is automatically illuminated whenever a power supply is connected to the apparatus.

Yet still another object of the present invention is to protectively house the electrical components of the sensor within the upper plate. The sensor is further powered by an electrical power supply such as an alternating current power supply or a removable battery power supply. The sensor is further situated within the upper housing so as to properly sense hazardous and emergency situations based upon the type of sensor utilized.

Yet still another object of the present invention is to include a buzzer which provides an audible alarm to additionally alert individuals who are not hearing impaired.

Yet still another object of the present invention is to include a variety of mounting means which enable removable attachment to a variety of surfaces including walls and ceilings. In at least one (1) embodiment, the mounting means includes a wall bracket installed along a wall surface and a curved arm affixed to the upper plate and removably attachable to the wall bracket so that the upper plate is oriented parallel to a ground surface upon attachment. In at least one (1) other embodiment, the mounting means includes a wall bracket installed along a wall surface, wherein the upper plate is removably attachable to the wall bracket. In at least one (1) other embodiment, the mounting means includes a mounting hook disposed along a top surface of the upper plate which enables the apparatus to be suspended from a hook.

Yet still another object of the present invention is to provide a method of utilizing the device that provides a unique means of acquiring the apparatus; attaching the apparatus to a desired surface using the mounting means; supplying an appropriate power which illuminates the operating light; allowing the sensor to sense a potential danger which triggers the illumination means and buzzer; allowing the illumination means and buzzer to warn a person or persons; and, providing a means of quickly notifying any and all persons in location of a dangerous situation regardless of their ability to hear.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
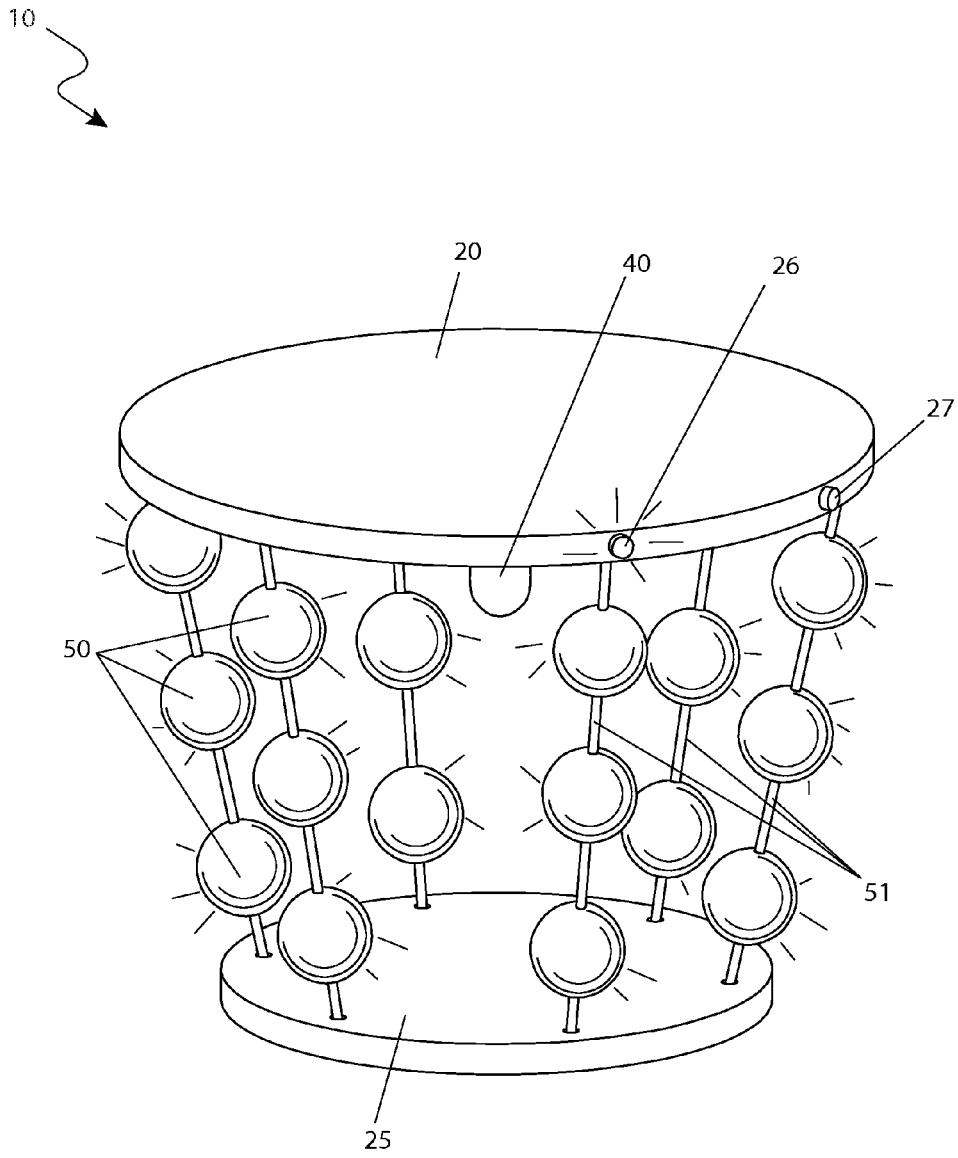
FIG. 1 is a perspective view of an instrument for detecting and alerting an emergency situation 10, according to a preferred embodiment of the present invention.

10 instrument for detecting and alerting an emergency situation
20 upper plate
25 lower plate
26 operating light
27 test/reset button
28 piezo buzzer
31 primary power source
32 sensor
33 electrical wiring
34 secondary power source
40 illumination means
50 decorative bead
51 bead attachment
60 first mounting means
61 first mounting plate
62 first mounting portion
70 second mounting means
71 second mounting plate
72 second mounting portion
80 third mounting means
81 mounting hook
82 third mounting portion

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an instrument for detecting and alerting an emergency situation (herein described as the "apparatus") 10, which provides a visual alarm means primarily utilized for persons whom are deaf, hearing impaired, or the like, yet may also be utilized for various persons not possessing a disability. The apparatus 10 comprises an upper plate 20, a lower plate 25, an illumination means 40, and a plurality of decorative beads 50. The apparatus 10 comprises an internal sensor 32 such as, but not limited to: a smoke sensor, a carbon monoxide sensor, a motion sensor, or the like which illuminates the illumination means 40 to alarm a person or persons within a structure or area surrounding the apparatus 10.

Referring now to FIG. 1, a perspective view of the apparatus 10, according to the preferred embodiment of the present invention, is disclosed. The apparatus 10 is attached to a various surfaces which are preferably a ceiling via a mounting device which is discussed within FIGS. 4 through 6 (see below). The apparatus 10 measures approximately three (3) to four (4) inches in length, yet other lengths may be utilized without limiting the scope of said apparatus 10. The apparatus 10 is fabricated from a material such as, but not limited to: plastic, metal, or the like.

The upper plate 20 and lower plate 25 comprise disc-shaped forms and provide the main supports of the apparatus 10. The upper plate 20 provides an attachment to a plurality of bead attachments 51 and provides housing to internal electrical components (see FIGS. 2 and 3). The lower plate 25 also provides an attachment to bead attachments 51. The distance between the upper plate 20 and lower plate 25 determines the length of the apparatus 10 and the amount of decorative beads 50 utilized. The bead attachment means 51 are preferably strings, cables, or the like and each proximal portion is attached to a lower surface of the upper plate 20 and are suspended from said lower surface via adhesives, knots, integral molding, or the like. The bead attachments 51 are preferably arranged around an offset circumference of each plate 20, 25. Each bead attachment means 51 provide a means to attach decorative beads 50 which provides an aesthetically pleasing aspect to the apparatus 10. The decorative beads 50 also provide reflective characteristics that which increases the luminosity of the illumination means 40 further ensuring the person is alarmed visually. Each bead attachment means 51 to comprise up to three (3) decorative beads 50. The decorative beads 50 are preferably a clear plastic or glass material in a prism-shape, yet other shapes, materials, sizes, and colors may be utilized without limiting the scope of the apparatus 10. The apparatus 10 comprises up to eight (8) bead attachment means 51, yet other amounts may be utilized which depends upon the size of the plates 20, 25. A distal portion of each bead attachment means 51 is also attached to a lower plate 25 which secures said bead attachment means 51 and corresponding decorative beads 50 between the plates 20, 25. The distal end portions of each bead attachment means 51 are secured to the lower plate 25 in a similar fashion to the bead attachment means 51 attached to the upper plate 20 as above-mentioned. The upper plate 20 and lower plate 25 comprise a diameter of approximately three (3) inches and a thickness of approximately one-half (½) of an inch which provides a compact embodiment, yet other dimensions may be utilized without limiting the scope of the apparatus 10.

An underside intermediate position upon the upper plate 20 comprises an illumination means 40 which provides a visual alarm to warn/alert the user of a dangerous event. The illumination means 40 is preferably a light-emitting diode (LED) yet other devices such as, but not limited to: a strobe light, light bulbs, or the like which also reflect against the decorative beads 50 to create additional alerting effect may be utilized. The illumination means 40 is preferably integrally molded to the underside of the upper plate 20 and interconnected via electrical wiring 33 to an internal portion of said upper plate 20 (also see FIGS. 2 and 3). When the sensor 32 is triggered the illumination means 40 erratically flashes which alerts the user of a potential danger within a structure.

Figure 2:
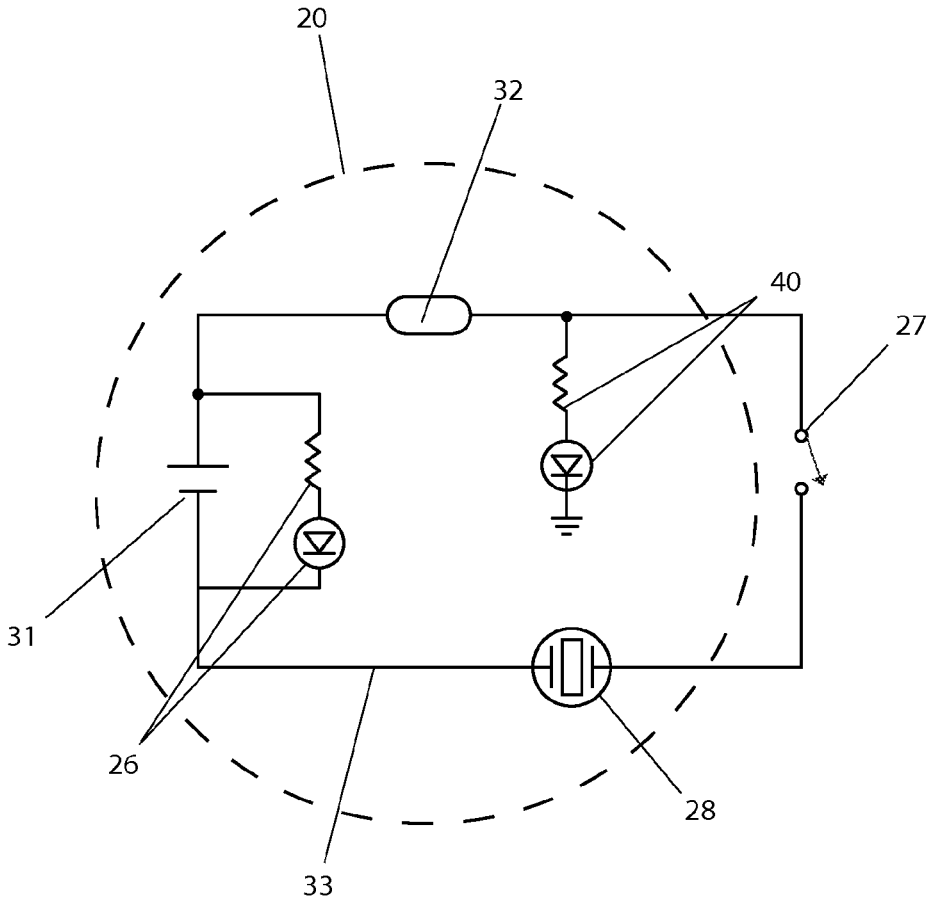
FIG. 2 is an electrical block diagram of the instrument for detecting and alerting an emergency situation 10, according to a preferred embodiment of the present invention.
Figure 3:
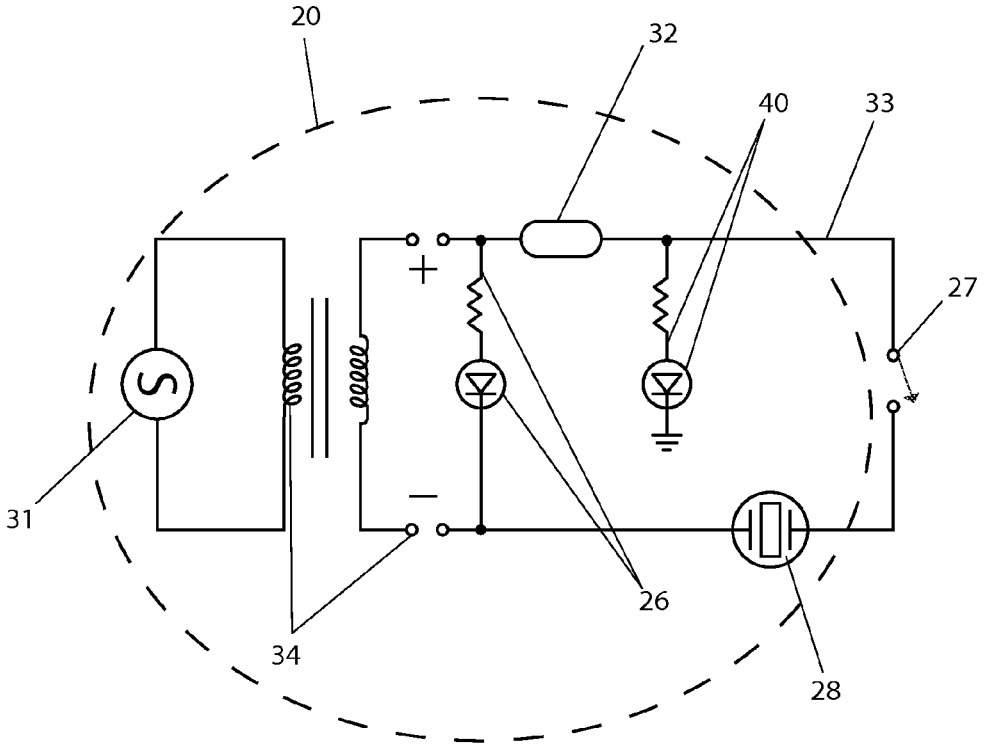
FIG. 3 is another electrical block diagram of the instrument for detecting and alerting an emergency situation 10, according to a preferred embodiment of the present invention.

A perimeter edge of the upper plate 20 comprises an operating light 26 and a test/reset button 27 which enable the user to visually and audibly know that the apparatus 10 is functioning properly (also see FIGS. 2 and 3). The operating light 26 is preferably a light-emitting diode which will illuminate when power is interconnected to the apparatus 10. The test/reset button 27 is preferably a pushbutton which is depressed to test a piezo buzzer 28 and reset the apparatus 10 after said apparatus 10 has been activated.

Referring now to FIG. 2, an electrical block diagram of the apparatus 10, according to the preferred embodiment of the present invention, is disclosed. The upper plate 20 houses electrical components which provide a sensing and alerting means. An internal portion of the upper plate 20 comprises electrical components which include a primary power source 31, a sensor 32, and a plurality of electrical wiring 33. The primary power source 31 is illustrated as a conventional alternating current (AC), yet other sources may be utilized (as shown in FIG. 3). As the primary power source 31 draws current the operating light 26 illuminates. The current is also supplying power to the sensor 32. The sensor 32 may be a smoke sensor, a carbon monoxide sensor, a motion sensor, or the like which alerts the user of a variety of hazardous and emergency situations. The sensor 32 is facilitated as to properly sense the hazardous and emergency situations; i.e. if a smoke detector is utilized the corresponding sensor 32 is positioned in a location that will properly sense smoke, if a carbon monoxide detector is utilized the corresponding sensor 32 is positioned in a location that will properly sense carbon monoxide, and if a motion detector is utilized the corresponding sensor 32 is positioned to properly sense motion. As the sensor 32 is triggered, the illumination means 40 illuminates in an erratic flashing fashion to alert persons, especially those who are hearing impaired, that are within the vicinity of the apparatus 10. A piezo buzzer 28 will also sound an audible alarm when the sensor 32 is triggered which alters other persons within the surrounding area of the apparatus 10 whom are not hearing impaired. The test/reset button 27 is depressed to reset the apparatus 10 to a non-active state and as abovementioned utilized to determine correct working functions.

Referring now to FIG. 3, another electrical block diagram of the apparatus 10, according to the preferred embodiment of the present invention, is disclosed. A secondary power source 34 may also be introduced into the apparatus 10 without limiting the scope of said apparatus 10. The secondary power source 34 is preferably a user replaceable or rechargeable battery, or as seen in the illustrated configuration, a transformer may be used to lower the voltage of the primary power source to a direct current (DC) level and power the abovementioned electrical components.

Figure 4:
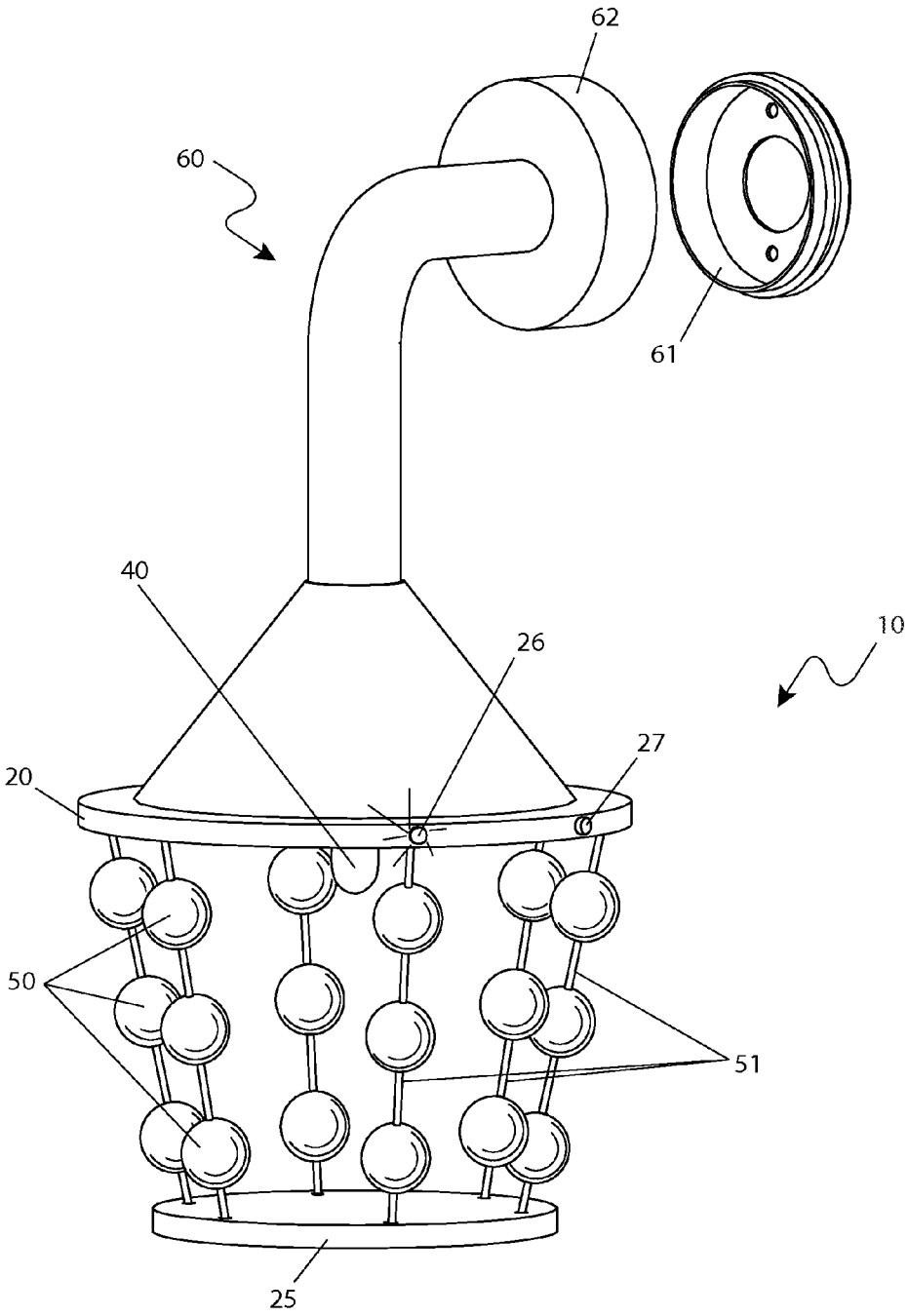
FIG. 4 is a perspective view of a first mounting means 60, according to a preferred embodiment of the present invention.
Figure 5:
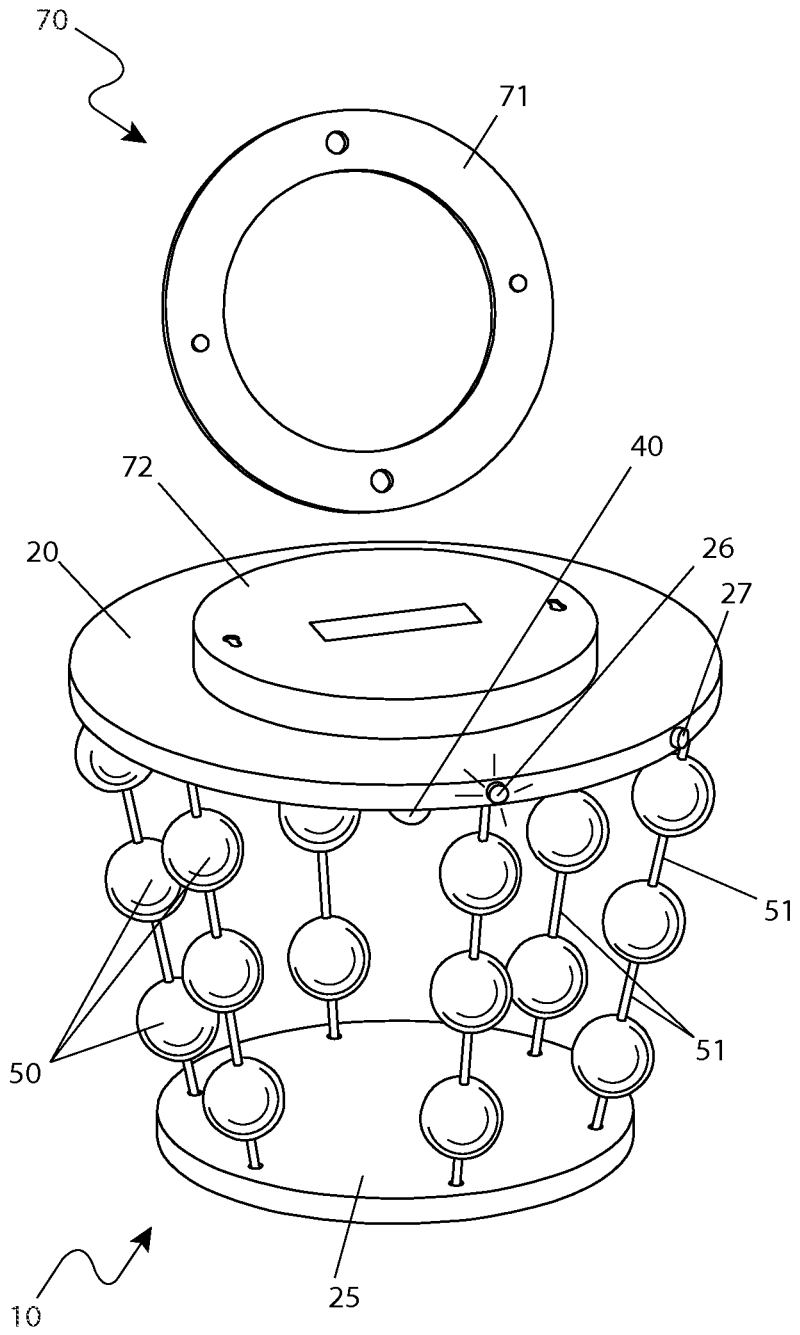
FIG. 5 is a perspective view of a second mounting means 70, according to a preferred embodiment of the present invention; and, FIG. 6 is a perspective view of a third mounting means 80, according to a preferred embodiment of the present invention.
Figure 6:
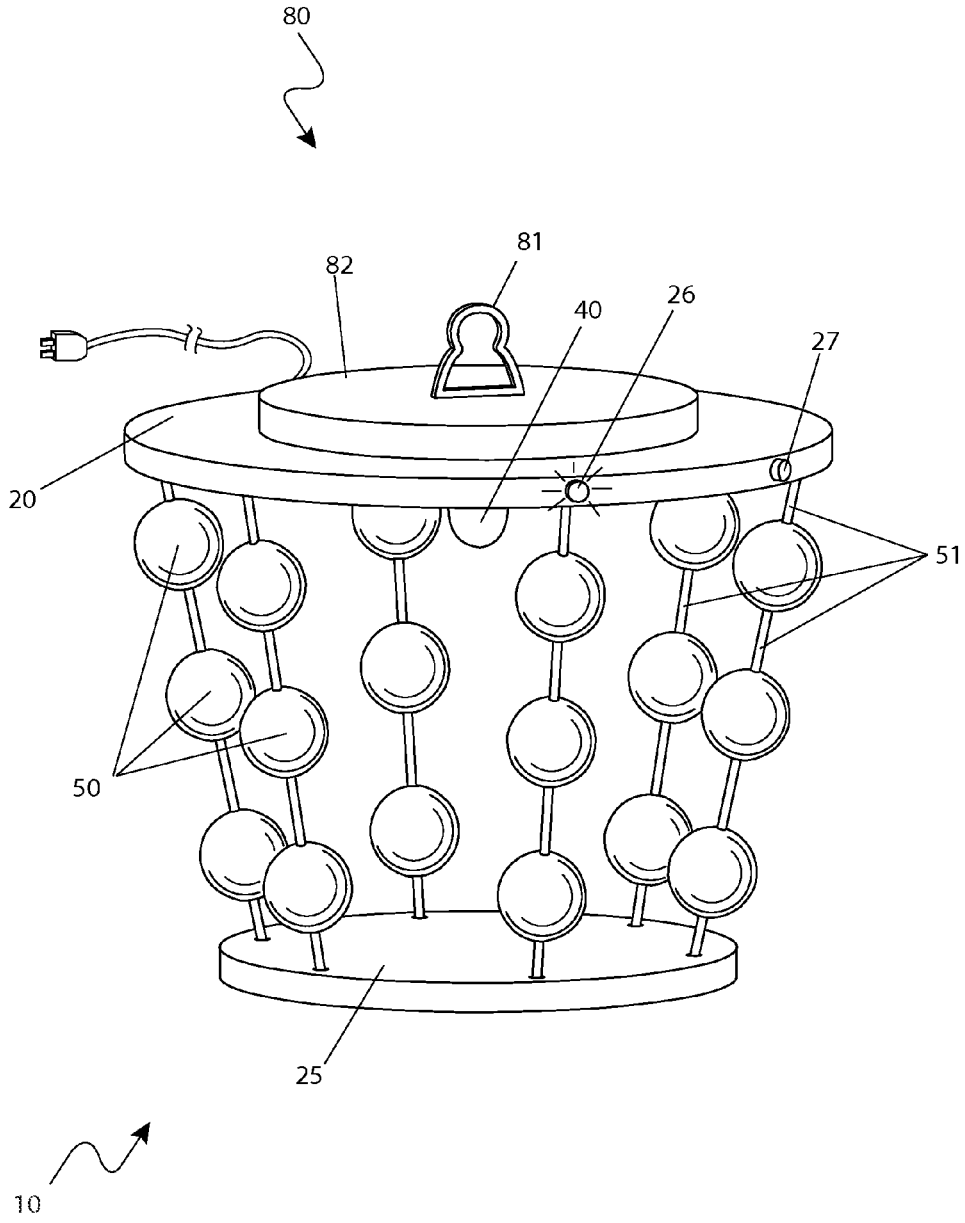

Referring now to FIG. 4, a perspective view of a first mounting means 60, FIG. 5, a perspective view of a second mounting means 70, and FIG. 6, a perspective view of a third mounting means 80, according to the preferred embodiment of the present invention, are disclosed. The apparatus 10 is suspended in a desired position via a mounting means which is attached to an upper surface of the upper plate 20. The mount may be introduced in a variety of ways as illustrated herein. FIG. 4 depicts a first mounting means 60 comprising a first mounting plate 61 and a first mounting portion 62 which comprises a wall bracket and a curved arm, respectively. FIG. 5 depicts a two (2) part second mounting means 70 comprising a second mounting plate 71 and a second mounting portion 72 being similar to an attachment means for standard conventional smoke detectors. FIG. 6 depicts a hanging third mounting means 80 which comprises a mounting hook 81 and a third mounting portion 82 allowing the apparatus 10 to be suspended from a hook at a desired location. The mounting means 60, 70, 80 enable the apparatus 10 to be mounted to a vertical surface such as, but not limited to: a wall, door, or the like. Each mounting means 60, 70, 80 is to be an integral part of the upper plate 20 and provides a variety of options to a user.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of utilizing the apparatus 10 may be achieved by performing the following steps: acquiring the apparatus 10; suspending the apparatus 10 to a vertical wall via the first mounting means 60 by installing the first mounting plate 61 to said wall surface; affixing the first mounting portion 62, or; mounting the apparatus 10 upon a ceiling by utilizing the second mounting means 70 by installing the second mounting plate 71 to the ceiling and affixing the second mounting portion 72 in a similar manner as a conventional smoke detector, or; hanging the apparatus 10 by utilizing the third mounting means 80 using the mounting hook 81 and third mounting portion 82 to suspend the apparatus 10 at a desired location; supplying an appropriate current to the primary power source 31 or secondary power source 34 which illuminates the operating light 26; testing the apparatus 10 via depressing the test/rest button 27 which sounds the piezo buzzer 28; allowing the sensor 32 to sense a desired potential danger which triggers the illumination means 40 and piezo buzzer 28; allowing the illumination means 40 and piezo buzzer 28 to warn a person or persons; resetting the apparatus via the test/rest button 27 as desired; and, providing a means of quickly notifying any and all persons in the structure of a dangerous regardless of their ability to hear.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A visual alert for emergency situations, comprising:

an upper plate;

a lower plate;

an emergency sensor in said upper plate for sensing a dangerous condition;

a plurality of bead attachments connecting said upper plate to said lower plate;

a plurality of reflective beads disposed on said plurality of bead attachments;

an illumination element disposed on the bottom of said upper plate;

an operating light located at the circumference said upper plate, said operating light lighting when electrical power is applied;

a test/reset button; and a buzzer;

wherein said illumination element flashes when said sensor senses said dangerous condition;

wherein said buzzer sounds when said illumination element flashes;

wherein said illumination element flashes and said buzzer sounds when said test/reset button is pressed; and where said emergency sensor is reset when said test/reset button is pressed.

2. The visual alert for emergency situations of claim 1, wherein at least one bead attachment means is connected to the circumference of said upper plate and to the circumference of said lower plate.

3. The visual alert for emergency situations of claim 1, further including a primary power source for powering said emergency sensor.

4. The visual alert for emergency situations of claim 1, wherein said mounting means comprises:

a mounting plate attached to said top plate;

a wall bracket; and a curved arm disposed between said wall bracket and said mounting plate.

5. The visual alert for emergency situations of claim 1, wherein said mounting means includes a mounting hook attached to said first plate.

6. The visual alert for emergency situations of claim 1 wherein said buzzer is a piezo buzzer.

7. The visual alert for emergency situations of claim 1, wherein said emergency sensor is a smoke sensor.

8. The visual alert for emergency situations of claim 1, wherein said emergency sensor is a fire sensor.

9. The visual alert for emergency situations of claim 1, wherein said emergency sensor is a a carbon monoxide sensor.

10. The visual alert for emergency situations of claim 1, wherein said illumination element is a light emitting diode that flashed erratically.

* * * * *